United States Patent [19]

Weihe et al.

[11] Patent Number: 4,954,250

[45] Date of Patent: Sep. 4, 1990

[54] FLATWARE SEPARATING APPARATUS

[75] Inventors: Clyde Weihe, Needham Heights; Lewis Maroti, Melrose; Peter Albertini, Dover, all of Mass.

[73] Assignee: Food Service Innovations, Inc., Dover, Mass.

[21] Appl. No.: 352,356

[22] Filed: May 16, 1989

[51] Int. Cl.[5] ..... B07C 5/12

[52] U.S. Cl. ..... 209/629; 209/632; 209/633; 209/644; 209/660; 209/673; 209/926; 209/932; 209/940

[58] Field of Search ..... 209/44.1, 44.2, 557, 209/606, 615–618, 629, 632, 633, 644, 651–654, 656, 658, 659, 660, 667–669, 671, 673, 707, 911, 932, 940

[56] References Cited

U.S. PATENT DOCUMENTS

| | | | |
|---|---|---|---|
| 909,413 | 1/1909 | Huntley | 209/656 |
| 1,459,553 | 6/1923 | Rocheleau | 209/673 |
| 2,340,775 | 2/1944 | Snyder | 209/644 |
| 2,417,878 | 3/1947 | Luzietti et al. | 209/644 |
| 3,247,858 | 4/1966 | Kraeft | 209/926 X |
| 3,545,613 | 12/1970 | Nystuen | 209/926 X |
| 3,583,564 | 6/1971 | Peters | 209/616 |
| 4,635,798 | 1/1987 | Bruck | 209/940 X |
| 4,750,621 | 6/1988 | Akesson et al. | 209/926 X |

FOREIGN PATENT DOCUMENTS

| | | | |
|---|---|---|---|
| 2042321 | 3/1972 | Fed. Rep. of Germany | 209/926 |
| 2915993 | 11/1979 | Fed. Rep. of Germany | 209/644 |

*Primary Examiner*—Johnny D. Cherry
*Assistant Examiner*—Edward M. Wacyra
*Attorney, Agent, or Firm*—M. Lawrence Oliverio

[57] ABSTRACT

A flatware separating apparatus comprising a track having a top surface for receiving and delivering different items of flatware along a selected path; a mechanism for contacting selected items of the flatware at a selected point along the path of the track and pushing the selected items off the surface of the track and allowing other selected items of the flatware to remain on the surface; and a mechanism for further separating the selected items of flatware pushed off the surface of the track.

39 Claims, 5 Drawing Sheets

FLATWARE SEPARATING APPARATUS

BACKGROUND OF THE INVENTION

The present invention relates to systems for separating different items of flatware and particularly to automated systems which can receive a plurality of different individual items of flatware, e.g. forks, knives and spoons, and automatically separate the different items into separated collections of the same items. Existing systems for separating one item of flatware from another item, such as a type ACS sorting apparatus available from Erres Storkok, Grums, Sweden, typically include complex mechanisms for identifying a particular individual item of flatware first, e.g. by shape, weight, size, dimension or the like, and then manipulating the item based on its pre-identification in such a way as to separate it from other differently identified items.

The apparatus of the invention is particularly useful in conjunction with a flatware cleaning apparatus which is used in a restaurant or cafeteria operation to constantly clean large numbers of soiled flatware items en masse. In such operations the cleaned collection of flatware must be quickly separated for relatively immediate re use

SUMMARY OF THE INVENTION

The present invention comprises an apparatus into which is loaded a collection of different items of flatware, e.g. forks, knives and spoons, and separates the entire collection into separate collections of the same items without the necessity of identifying an individual item prior to its being separated.

The apparatus includes a track onto which is delivered one or more of the same or different items of flatware, the track defining a path along which the flatware items are routed past a stream of fluid which pushes spoons and/or forks off the track and leaves knives on the track. The knives are thus initially separated from forks and spoons. The knives remaining on the track are routed into a separate collection bin. The fluid stream impacting the forks and spoons is typically routed into contact with a baffle mechanism which causes the entrapped forks and spoons to fall by their weight out of the direction of the flow of the stream of fluid and into the nip of a pair of rollers. The width of the nip of the rollers is pre-selected such that the forks can slide through the nip and such that the spoons are caught in the nip. The forks which slide through the nip of the rollers are routed into a separate collection bin and the spoons which remain between the rollers are routed into another separate collection bin.

In accordance with the invention there is provided a flatware separating apparatus comprising a track mechanism having a top surface for receiving and delivering different items of flatware along a selected path; a mechanism for contacting selected items of the flatware at a selected point along the path of the track and pushing the selected items off the surface of the track and allowing other selected items of the flatware to remain on the surface; and a mechanism for further separating the selected items of flatware pushed off the surface of the track.

The mechanism for contacting is mounted above the top surface of the track a distance sufficient to both contact the selected items of flatware and avoid contacting the other selected items of flatware. The mechanism for contacting is typically mounted relative to the top surface of the track means such that selective contact of the selected items of flatware and allowance of the other selected items to remain on the surface is determined according to the thickness of the items of flatware.

The mechanism for contacting may comprise a fluid spray mechanism for directing a stream of fluid across the surface of the track at a selected point along the path of the track, the fluid stream contacting the selected items of flatware and pushing the selected items off the surface of the track and allowing other selected items of the flatware to remain on the surface. The fluid spray mechanism may comprise a nozzle disposed on one side of the track directing the stream of fluid over tho top surface of the track through a space above the surface of the track into which the selected items of flatware extend when lying adjacent the nozzle on the surface of the track, the fluid stream pushing the selected items off the track to the other side thereof.

The mechanism for further separating preferably comprises a pair of rollers with the selected items of flatware being delivered by gravity to between the rollers. The rollers are separated a distance apart sufficient to allow certain of the selected items delivered to between the rollers to pass through the separation and to prevent certain other of the selected items delivered to between the rollers from passing through the separation.

The track mechanism is typically mounted at an angle relative to horizontal sufficient to allow the items of flatware to slide along the top surface of the track under the force of gravity.

The rollers are drivably rotated, the angle of mounting of the rollers being selected to allow the certain other items of the flatware prevented from passing through their nip to slide along the length of the rollers under the force of gravity while the rollers are rotating.

The apparatus preferably includes a baffle for directing the selected items of the flatware pushed off the track means by the stream to between the rollers, the baffle being mounted on the other side of the track in the path of the stream of fluid, the stream of fluid pushing the selected items of flatware into contact with the baffle, the baffle including a mechanism for directing the selected items of flatware to between the rollers under the force of gravity.

Most preferably the apparatus includes a mechanism for delivering no more than two individual items of flatware at a time onto the top surface of the track means.

The flatware is typically a combination of knives, forks and spoons or knives and forks, or knives and spoons or forks and spoons and the selected items of flatware which are pushed off the surface of the track means by the fluid stream are forks, spoons and combinations thereof. The selected items of flatware allowed to pass through the separation of the rollers are forks and the other items of flatware prevented from passing through the separation of the rollers are spoons.

In a preferred embodiment the rollers are mounted side by side with one of the rollers being mounted at a slightly greater angle than the other, the one roller rotating in a direction upwardly and outwardly from the separation between the rollers, and the other roller rotates in the same direction as the one roller. The one roller most preferably includes a selected array of protrusions on the surface thereof, and the one roller rotates faster than the other roller.

In an alternative embodiment, the mechanism for contacting might comprise a driven roller wheel disposed across the path of the flatware along the track so as to contact the selected items of flatware and far enough above the top surface of the track so as not to contact the other selected items of flatware.

DETAILED DESCRIPTION OF PREFERRED EMBODIMENTS

The following description sets forth typical embodiments of the invention with reference to the Figures.

Figure 1:
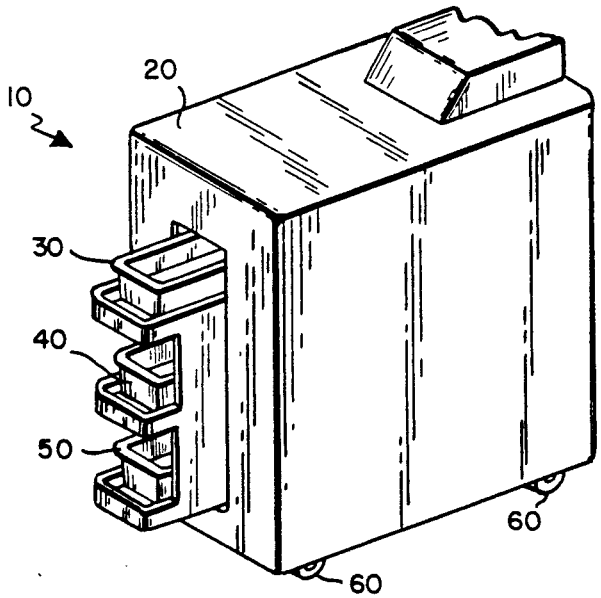
FIG. 1 is a side isometric view of a flatware separating apparatus according to the invention showing the apparatus housing and its mounting on wheels.

With reference to FIG. 1, there is shown a flatware separating apparatus 10 according to the invention comprising a housing 20, a collection bin for knives 30, a collection bin for spoons 40 and a collection bin for forks 50. The apparatus 10 may be rendered portable by mounting on wheels 60.

Figure 2:
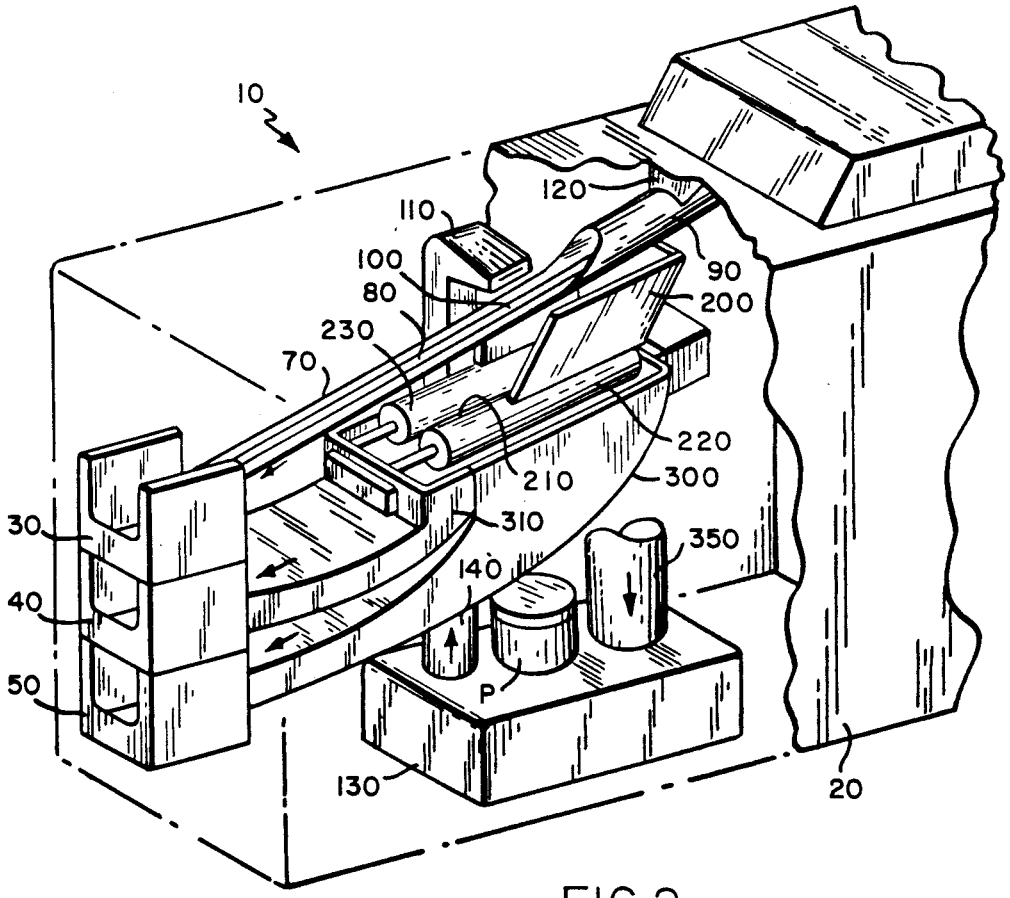
FIG. 2 is a side schematic isometric view of the operational elements of the FIG. 1 device.

As shown in FIG. 2, the apparatus includes a track 70 mounted at an angle relative to horizontal within the housing 20. The track 70 typically comprises a straight length of sectioned tubing having an upwardly disposed recess 80 into which one or more forks, knives and/or spoons are deposited at a point along the length of the track 70, such as point 90, which is at a higher elevation than the point 100 at which a fluid spray nozzle 110 is disposed.

The forks, spoons and knives may be initially deposited into a funnel 120 which aligns the flatware longitudinally with the recess 80 and insures that the flatware will be longitudinally deposited within the recess 80. Once the items are deposited into the recess 80 at a point such as about 90, the flatware items slide downwardly along the surface of the recess 80 toward the point 100 at which the nozzle 110 is mounted. The track 70 is typically comprised of a rigid, impact resistant material which has a relatively low coefficient of friction relative to the materials of which the flatware is comprised. Typical materials of which the track may be comprised are impact resistant materials such as polyvinyl chloride, polyethylene, polypropylene, polyurethane, polycarbonates, metal and the like. In a typical embodiment of the invention, the track 70 is comprised of polyvinyl chloride, the flatware items are comprised of metal, and the track 70 is mounted at an angle of between about 12 and about 22 degrees relative to horizontal. The precise angle at which the track 70 is mounted is selected to at least allow the items of flatware deposited thereon to slide downwardly along the length thereof under the force of gravity. The precise angle selected will vary depending at least on the size, configuration, weight and material of which the flatware is comprised, the velocity of stream 160, the material of which the top surface of track 70 is comprised and the like.

Figure 3:
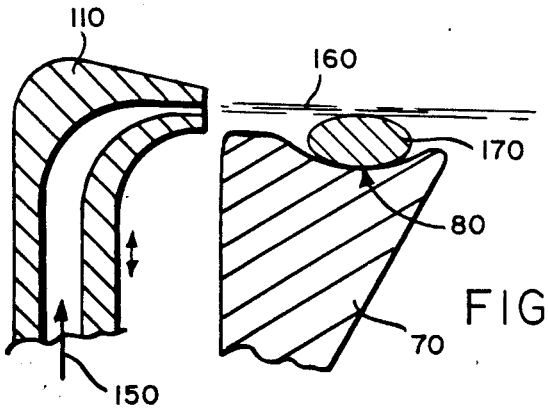
FIG. 3 is a cross-sectional view of fluid spray nozzle and track components of the FIG. 1 apparatus showing the positioning of the nozzle and a fluid stream emitted therefrom relative to a knife as the knife slides past the nozzle along the top surface of the track.
Figure 4:
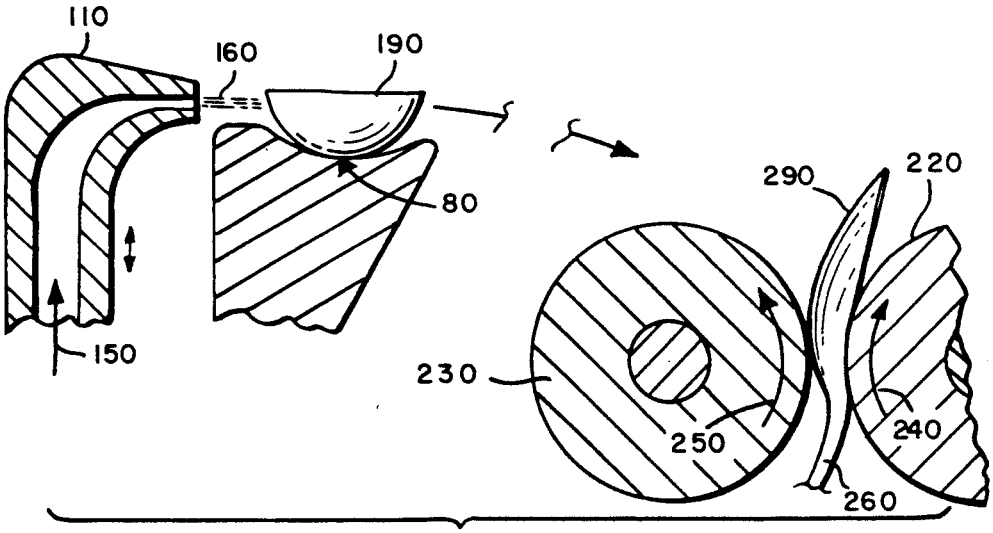
FIG. 4 is a cross-sectional view of fluid spray nozzle and track components of the FIG. 1 apparatus as well as a partial cross-sectional view of separating rollers with a spoon entrapped in the nip thereof, schematically showing a fluid stream being emitted from the nozzle, pushing a spoon off the track and a subsequent positioning of the spoon within the nip of the rollers after the spoon has been pushed off the track.
Figure 5:
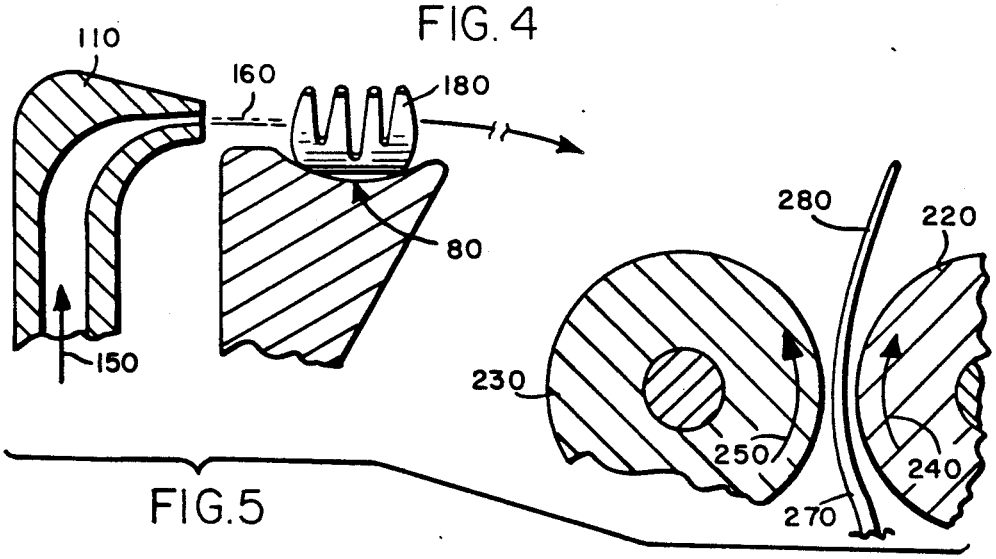
FIG. 5 is a cross-sectional view of fluid spray nozzle and track components of the FIG. 1 apparatus as well as a partial cross-sectional view of separating rollers with a fork sliding through the nip thereof, schematically showing the fluid stream emitted from the nozzle pushing fork off the track and the subsequent sliding of the fork through the nip of the rollers after the fork has been pushed off the track.

The apparatus 10 typically includes a reservoir 130 filled with water which is pumped via pump P through a feed tube 140 into nozzle 110. With reference to FIGS. 3–5 the water 150 which is pumped into nozzle 110 is directed through an aperture in the nozzle 110 such that a stream 160 of water is directed through a space across the surface of recess 80. The nozzle 110 is positioned on one side of the track 70 such that stream 160 passes through a space above the space through which a knife 170, FIG. 3, would pass when sliding on the surface of the recess 80 past the nozzle 110. As shown in FIGS. 4, 5 the nozzle 110 is also mounted such that the space through which the stream 160 passes includes or intersects the space through or into which at least a portion of a fork 180 or a spoon 190 extends when sliding on the surface of the recess 80 past the nozzle 110.

In a typical embodiment of the invention the aperture of the nozzle 110 through which the stream 160 is emitted is generally rectangular, i.e., slit-like, typically about 2 to 4 inches long and about 0.09 to 0.16 inches wide such that the stream which comes into contact with the forks 180 and spoons 190 can more effectively push or entrap the forks 180 and spoons 190 as they slide past nozzle 110. In order to insure that the stream 160 makes contact with the portions of the forks 180 and spoons 190 which extend upwardly above the surface of the track 70, the nozzle is typically mounted relative to the track 70 such that the bottom most edge of the stream 160 is between about 0.25 and about 0.5 inches above the upper surface of the track 70. Preferably a conventional mechanism is provided to allow the nozzle 110 to be adjusted upwardly and downwardly relative to the upper surface of the track 70. Most preferably the mechanism provided for adjusting the upward/downward movement of the nozzle 110 includes an automated drive mechanism which is controllable by the user to select the degree of upward or downward movement by programmable or push button means.

The water 150 is pumped at such a rate that the stream 160 impacts with a fork 180 or knife 190 sufficiently to push the fork 180 or spoon 190 off the track 70 and into contact with a baffle mechanism 200 mounted on the other side of the track 70, FIG. 2. The velocity of the stream 160 is preferably controllable by inclusion of conventional mechanisms for controlling the rate of pumping by the pump P, the width of the nozzle aperture or the like. Most preferably such mechanisms are also provided with programmable or other electronic or electromechanical means for allowing the user to conveniently select and control the velocity of the stream 160 according to the shape, size, weight and the like of the forks 180 and spoons 190 to be driven off the track by the stream 160 as well as the distance the forks 180 and spoons 190 are to be driven off the track 70.

As shown in FIG. 2, the baffle 200 comprises a planar barrier sloping downwardly toward the nip 210 of a pair of rollers 220, 230. The forks 180 and spoons 190 which are pushed into contact with the baffle 200 thus impact with the sloped surface of the baffle 200 and slide under the force of gravity along the sloped surface of the baffle 200 and are routed into the nip 210 of the rollers 220, 230.

Although a water fluid spray is typical for use in the invention, a gas, such as air, may alternatively be utilized as the fluid to be pumped to the nozzle 110. As described above with reference to an embodiment where water is utilized, the velocity of a gas stream emanating from nozzle 110 is preferably selected so as to cause forks 180 and spoons 190 to be pushed off the surface of track 70 such that the forks 180 and spoons 190 are suitably directed (directly or after impact with a baffle mechanism such as 200) to land between the rollers 220, 230. Similarly where a gas is the selected fluid, the apparatus 10 is preferably provided with mechanisms for selecting and controlling the velocity of a gas stream emanating from nozzle 110 in order to allow a preferred workable velocity to be readily selected.

Figure 9:
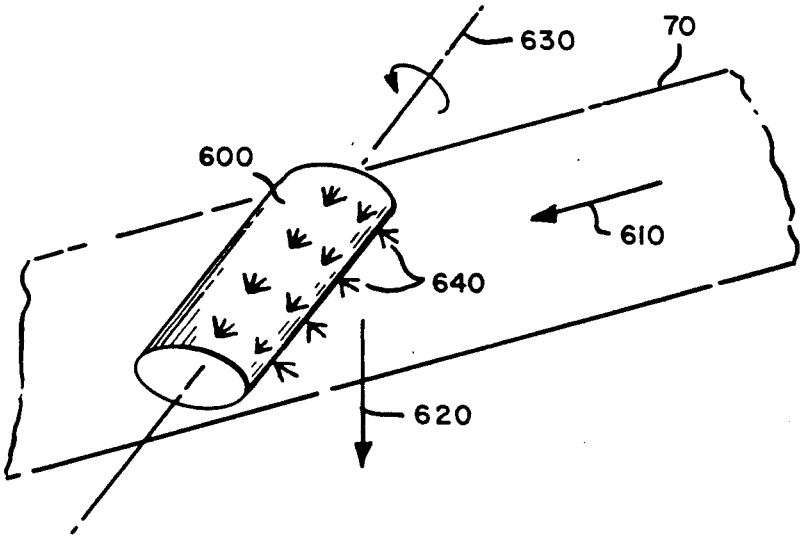
FIG. 9 is a top schematic isometric view of a ejection roller mechanism showing its disposition relative to the track component in one embodiment of the invention.

In another alternative embodiment of the invention, the mechanism for selectively pushing the forks 180 and spoons 190 off the track 70 may comprise something such as a rotating roller 600 mounted above and across the path 610 of the flatware sliding along track 70, FIG. 9. The roller 600 is mounted far enough above the surface of the track 70 so as not to come into (push off) contact with knives 170 which slide 160 past the point of track 70 above which roller 600 is disposed, i.e. such that knives 170 slide under the roller 600. The roller 600 is, however, mounted close enough to the top surface of the track 70 such that the roller 600 invades the space above the surface of the track 70 into which the bowl 290 and tooth 280 portions of the spoons 190 and forks 180 extend. The roller 600 is also drivably rotated in a suitable direction 630 relative to its orientation relative to path 610 so as to push the sliding 610 spoons 190 and forks 180 off the track in a predetermined direction 620 toward the rollers 220, 230. As shown in FIG, 9, the roller 600 is typically provided with an array of protruding brushes 640 on and around the surface thereof such that when a sliding fork 180 or spoon 190 reaches the point where roller 600 is mounted, the forks 180 or spoons 190 contact the brushes 640 which soften the impact of the forks 180 or spoon 190 with the roller 600. In any embodiment of the invention, a baffle such as 200, FIG. 2, or other suitable chute, tube or routing mechanism is most preferably included for purposes of redirecting the path of travel of the forks 180 and spoons 190 when pushed, e.g. 620, off the track 70 in order that the forks 180 and spoons 190 may be more controllably routed at slower speed onto and between 210 the rollers 220, 230.

The rollers 220, 230 may be drivably rotated by conventional means (not shown) in opposite directions 240, 250 such that the forks 180 and spoons 190 which are delivered into the nip 210 are continuously jostled about so as to cause the forks 180 and spoons 190 to become longitudinally aligned with the longitudinal length of the nip 210. The rotational movement 240, 250 is preferred insofar as forks 180 and spoons 190 which are initially delivered on top of the rollers 220, 230 are jostled or agitated upwardly and outwardly from the nip 210 and not inwardly into the nip 210. Once the forks 180 and spoons 190 ar delivered onto the rollers 220, 230 they eventually align themselves under the influence of the driven roller agitation and their own weight with the longitudinal length of the nip 210. Once the forks 180 and spoons 190 align themselves with the length of the nip 210, their handle ends 260, 270 slide through the nip 210. The tooth ends 280 of the forks 180 also eventually slide entirely through the nip 210 (under the force of the weight of the forks 180) by virtue of the natural contour of the forks 180 which have a maximum tooth end 280 thickness which is smaller than the width of the nip 210. The spoons 190, on the other hand, have a contour which allows their handles 260 to eventually slide through the nip 210 but not their bowl ends 290. As shown in FIG. 4 the bowl shape of the bowl ends 290 of the spoons 190 have a slimmest bowl dimension which is wider than the width of the nip 210 and the spoon is thus prevented from sliding therethrough.

As shown in FIG. 1, a receiving chute 300 is provided for receiving the forks 180 after they have passed through the nip 210. The chute 300 routes the separated forks 180 into a fork collection bin 50.

The rollers 220, 230 are mounted at an angle relative to horizontal sufficient to allow the spoons 190 which are caught in the nip 210. FIG. 4, to slide downwardly along the length of the rollers to the ends thereof (typically between about 8 and about 22 degrees relative to horizontal) whereupon the spoons fall off the end of the rollers and into a chute 310 which routes the spoons into a separate spoon collection bin 40. Again the rollers 220, 230 are continuously driven during the entire operation also assisting in the spoons sliding movement along the length of the rollers. The rollers typically comprise, or at least have an outside surface which typically comprises a smooth, impact resistant, low friction (relative to the material of the forks and spoons) material such as metal, polyvinyl chloride, polypropylene, polyethylene, polyurethane and the like. Whatever material is selected, the rollers 220 230 are mounted at such an angle relative to horizontal as is sufficient to enable the spoons caught within the nip 210, FIG. 4, to slide downwardly along the surface of the rollers 220, 230 toward the chute 310 under the force of gravity. The preferred degree of the roller mounting angle may vary depending on whether and how fast the rollers are drivably rotated during the operation (which will reduce the amount of friction which the spoons 190 will have to overcome in order to slide along the rollers 220, 230), the materials out of which the surface of the rollers and the spoons are constructed, the precise configuration of the bowl ends 290 of the spoons, the width of the nip 210 and the like. In a typical embodiment of the invention, the nip 210 width is between about 0.19 and about 0.3125 inches, the mounting angle of the rollers is between about 8 and about 22 degrees relative to horizontal, the diameter of the rollers is between about 2 and about 6 inches, the rotational speed of the rollers is between about 75 and about 125 rpm's and the spoons and the surface of the rollers are comprised of metal material.

Figure 8:
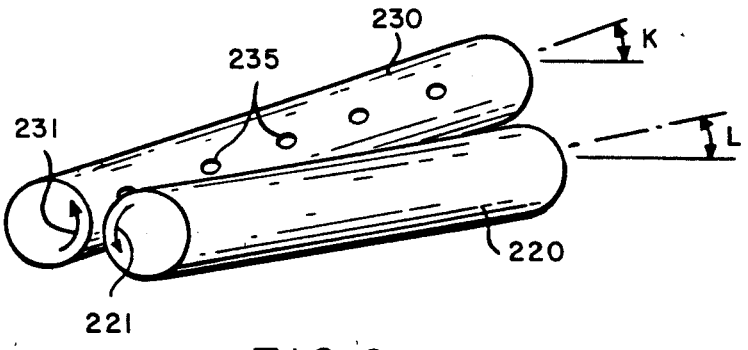
FIG. 8 is a side schematic isometric view of a pair of skewed separating rollers usable as a component in one embodiment of the invention.

In a most preferred embodiment of the invention, the rollers 230, 220 are mounted slightly askew to each other, i.e. one roller, e.g. 230, FIG. 8, is mounted at a slightly greater angle K relative to horizontal than the angle L at which roller 220 is mounted, e.g. angle K is about 1–10 degrees greater than angle L. In such an embodiment the rollers 220, 230 preferably rotate in the same directions 221, 231 with roller 231 rotating in a direction such that roller 230 is rotating upwardly and outwardly 231 relative to the gap or nip between the rollers 220, 230. In such an embodiment, the gap between the rollers 220, 230, FIG. 8, is typically between about 190 and about 250 mils, the diameter of the skewed rollers 220, 230 is typically between about 4.0 and about 5.5 inches and the more inclined roller 230 preferably rotates at higher rpm's than roller 220. For example, roller 230 is driven about 3 to 6 times faster than roller 220. In a typical embodiment where rollers 220, 230 have about a 5.0 inch diameter, roller 230 is rotated at about 100–140 rpm's and roller 220 is rotated at about 20–40 rpm's. Most preferably the more inclined roller 230 is provided with an array of small protrusions 235 on the surface of the roller 230, e.g. a linear array as shown in FIG. 8 of, for example, partially spherical-like shaped (e.g. 5/16 inch diameter) protrusions 235. Further typically roller 220 is mounted at about 9 to 22 degrees relative to horizontal, and roller 230 is mounted at about 1–10 degrees greater than roller 220.

In embodiments where the rollers 220, 230 are not mounted askew, the rollers 220, 230 may also be rotated in the same directions with the proviso that one of the rollers should rotate about 3–6 times faster than the other roller and that the faster rotating roller should rotate upwardly and outwardly relative to the gap between the rollers. Also, most preferably, in such an alternative embodiment, the surface of the faster rotating roller should include an array of protrusions thereon such as described for example with reference to FIG. 8.

As shown in FIG. 2, the rollers 220, 230 are disposed on the side of the track 70 opposite the side on which the nozzle 110 (or other pushing mechanism) is disposed. As can be imagined the velocity of the stream 160 could be adjusted to cause the forks 180 and spoons 190 to be delivered directly toward the rollers 220, 230 such that the forks 180 and spoons 190 fall by their weight out of the stream 160 directly onto the rollers 220, 230 and into the nip 210. Preferably, however, the forks 180 and spoons are pushed or carried by the stream 160 into contact with the baffle 200 which more controllably routes the flatware 180, 190 toward the nip 210.

Although the rollers 220, 230 are typically mounted on the side of the track 70 opposite the side on which the nozzle 110 is disposed, the rollers 220, 230 may be disposed elsewhere, with the baffle mechanism 200 including a mechanism, e.g. a tube, funnel or chute, for routing the flatware to the rollers.

The baffle 200 may include a mechanism such as a screen (not shown) for allowing a stream 160 (e.g. of water) to continue to flow through the baffle 200 and into a tube 350 which may route the stream 160 back into a feed reservoir 130. Other mechanisms for collecting a stream 160 of water and routing it back to the reservoir 130 can be readily imagined.

Figure 6:
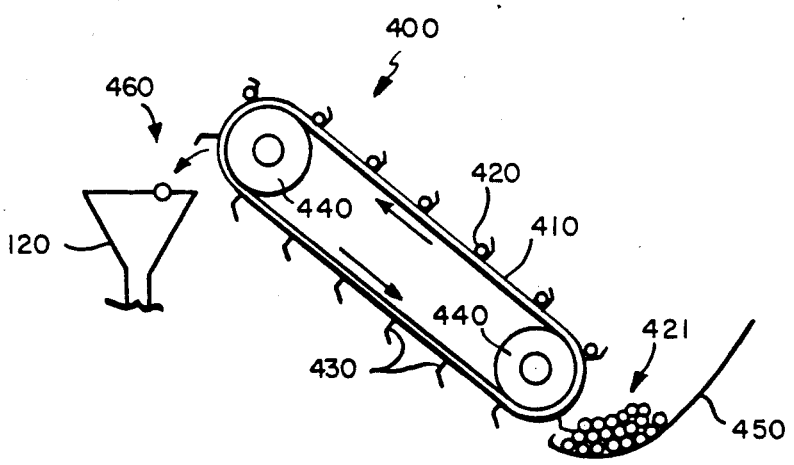
FIG. 6 is a schematic side cross-sectional view of one embodiment of an assembly for delivering individual flatware items at a time to the track of the apparatus according to the invention.

Most preferably the apparatus 10 includes an automated mechanism for delivering one or two individual items of flatware at a time into the recess 80 of the track 70 at a point such as 90 above the nozzle point 100. One such mechanism, for example, may comprise a delivery mechanism 400, FIG. 6, comprising an endless belt 410 having a series of spaced trays 430 attached to the outside surface of the belt 410, the trays 430 being only large enough to accommodate a single item or two of flatware 420 thereon. The belt 410 is driven by a pair of rollers 440 in the direction shown by the curved arrows in FIG. 6. A supply of a plurality of flatware items 421 is loaded into a feed tray 450 which positions the items 421 for pickup by the trays 430 as they are driven around on the belt 410. The roller/belt assembly 400 is typically mounted at an angle as shown in FIG. 6 such that when the trays 430 are driven around the uppermost end 460 of the assembly, the individual items of flatware 420 engaged within the trays can be deposited into, for example, the funnel 120, directly into the recess 80, FIG. 2, or by other conventional means such that the flatware items 420 are delivered one or two at a time into the recess 80.

Figure 7:
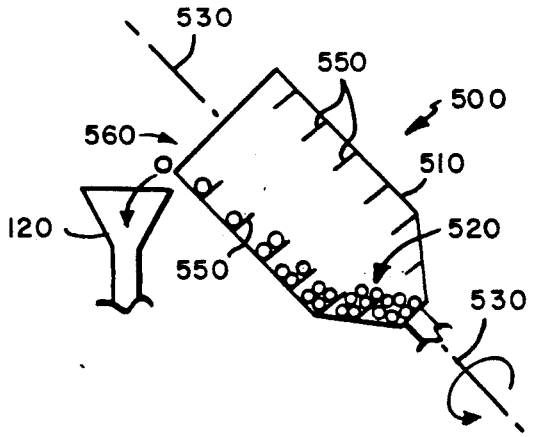
FIG. 7 is a schematic side cross-sectional view of another embodiment of an assembly for delivering individual flatware items at a time to the track of an apparatus according to the invention.

Another typical mechanism 500, FIG. 7, for delivering one or two items or flatware at a time may comprise a tub 510 into which is loaded a plurality of flatware items 520. The tub is typically a generally cylindrical receptacle 510 (shown in cross-section in FIG. 7) which is drivably rotated around an axis 530. The tub 510 includes a helical screw or thread 550 which winds around the inside surface of the tub 510 and screwably carries the flatware 520 upwardly toward the open end of the tub 510 between the threads 550. As the flatware items 520 are carried upwardly by the threads, fewer items 520 are maintained at a time on the upward surfaces of the thread 550 such that when the flatware 520 reaches the uppermost lip 560 of the screw 550, only one or two items of flatware are delivered at a time out of the tub 510 into, for example, the funnel 120 such that only one or two items of the flatware 520 are ultimately delivered at a time into the recess 80 of the track 70.

Figure 10:
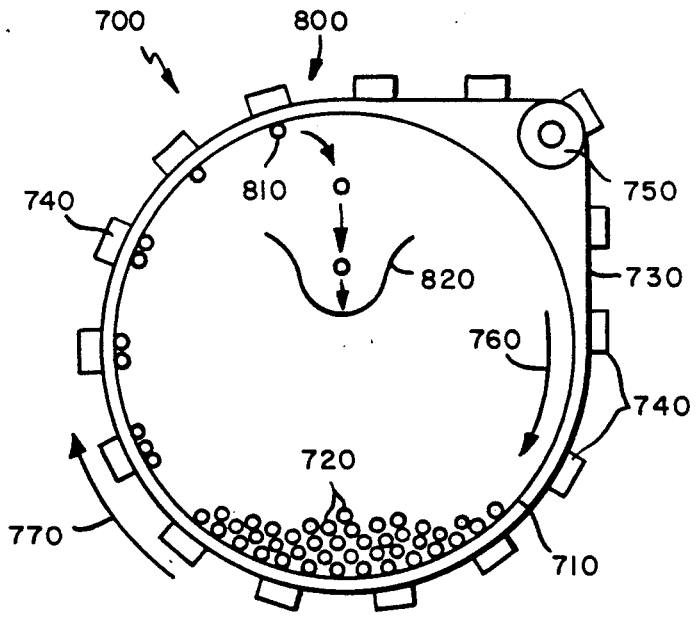
FIG. 10 is a cross-sectional schematic view of another embodiment of an assembly for delivering individual flatware items at a time to the track of an apparatus according to the invention.
Figure 11:
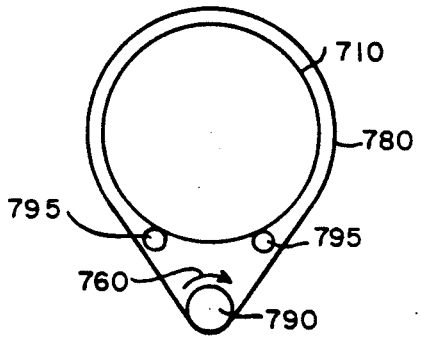
FIG. 11 is a cross-sectional schematic view along another cross-section of the FIG. 10 apparatus showing typical drive belt and drive roller components therefor.

Yet another mechanism 700 for delivering one or two items of flatware 720 to the surface of track 70 is shown in schematic cross-sectional form in FIG. 10. The mechanism 700 comprises a drum 710 around which is placed a belt 730 having magnets 740 serially attached thereto. The belt 730 is strung around the drum 710 and a roller 750 which is disposed laterally to and typically slightly above the drum 710. The drum is rotatably mounted and when the drum 710 rotates 760, the belt 730 rotates together with the drum 770. The drum 710 may be drivably rotated 760 in any conventional manner. For example a separate drive belt 780 may be strung around the drum 710 at a cross-section of the drum 710, FIG. 11, which is spaced apart from the cross-section, FIG. 10, around which belt 730 is strung. As can be imagined, the drive belt 780 is also tautly strung around a drive roller 790, FIG. 11, which when driven by suitable motor means will cause the drum 710 to rotate 760. Alternatively roller 750 could be driven and the combination of belt 730 and roller 750 could be utilized to drive the drum 710.

A plurality of flatware items 720 is loaded into the drum 710 and as the drum 710 rotates the belt 730 also rotates 770. As the belt 730 rotates 770, the magnets 740 will each cause one or two or three items of flatware initially to be carried along upwardly along the inside edge of the drum 710 as shown schematically in cross-section in FIG. 10. By virtue of the disposition of conveyor roller 750 relative to drum 710, the belt 730 and the magnets 740 become displaced away from the drum 710 at a selected upward position 800. At position 800, the magnetic force of the magnets 740 is gradually drawn away from the item(s) 810 and the item(s) 810 falls by its weight into a chute 820 which is suitably mounted so as to allow the item(s) 810 to slide down the chute 820 and be routed onto the surface of the track 70. Most preferably the magnetic strength of each magnet 740 relative to a typical item of flatware 720 is selected such that each magnet 740 is only capable of holding one item 810 of flatware 720 in suspension inside drum 710 as the magnet 740 begins to reach the upper detachment point 800 of the belt 730 from the drum 710. The drum 710 may be rotatably mounted in any conventional manner, for example, by an axle connected along the drum 710 axis, by roller wheels 795, FIG. 11, or the like. Most preferably the rotating drive mechanisms, e.g. drive roller 790 and its associated motor (not shown) are driven at such a rate so as to cause one magnet 740 to be drawn away from drum 710 at point 800 about every 1–3 seconds, thus resulting in one or two items 810 of flatware being deposited in chute 820 about every 1–3 seconds. Typically the drum has a diameter of about 1.5–3.0 feet and the magnets 740 are spaced about 2–5 inches apart along belt 730.

Other mechanisms may be employed to effectively deliver one or two items of flatware at a time onto the surface of the recess 80 of the track 70.

As can be readily imagined, the integration of the sorting apparatus described above with a flatware cleaning operation would be particularly economical in terms of labor with respect to a large scale food service operation. Such a cleaning operation would normally be carried out prior to input of flatware items into a sorting apparatus. With respect to the sorting apparatus described herein, the cleaning operation could be incorporated together with the apparatus selected for delivering the flatware to the track mechanism 70, FIGS. 2–5. For example, with respect to the delivery apparatus of FIG. 7, the tub 510 could be used as a cleaning tub whereby the tub 510 is filled with a certain amount of water, appropriate cleansing agents added to the water and a large collection of forks, spoons and knives loaded into the tub 510. The tub 510 could be provided with a drive mechanism which articulates the tub 510 back and forth between clockwise and counterclockwise rotations around the axis of the tub 510 for a suitable period of time so as to provide agitation of the flatware within the water cleansing solution in aid of cleansing the flatware. Conventional jet spray mechanisms for spraying water, draining mechanisms for removing the water, heating mechanisms for drying, program control mechanisms for sequentially activating and deactivating rinsing, heating and draining mechanisms and finally for rotating the tub 510 in one direction for delivering the flatware to the track 70 may also be combined with a suitable flatware delivery assembly such as described with reference to the FIG. 7 apparatus. With respect to the FIGS. 6 and 10 apparati, similar mechanisms for cleaning, drying, rinsing, heating and the like could be incorporated therewith.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. A flatware separating apparatus comprising:

a track means having a top surface for receiving and delivering different items of flatware along a selected path;

means for contacting selected items of the flatware at a selected point along the path of the track means and pushing the selected items off the surface of the track means and allowing other selected items of the flatware to remain on the surface; and means for further separating the selected items of flatware pushed off the surface of the track means.

2. The apparatus of claim 1 wherein the means for contacting is mounted above the top surface of the track means a distance sufficient to both contact the selected items of flatware and avoid contacting the other selected items of flatware.

3. The apparatus of claim 2 wherein the means for contacting is mounted relative to the top surface of the track means such that selective contact of the selected items of flatware and allowance of the other selected items to remain on the surface is determined according to the thickness of the items of flatware.

4. The apparatus of claim 1 wherein the means for contacting comprises a fluid spray means for directing a stream of fluid across the surface of the track means at a selected point along the path of the track means, the fluid stream contacting the selected items of flatware and pushing the selected items off the surface of the track means and allowing other selected items of the flatware to remain on the surface.

5. The apparatus of claim 4 wherein the fluid spray means comprises a nozzle disposed on one side of the track means directing the stream of fluid over the top surface of the track means through a space above the surface of the track means into which the selected items of flatware extend when lying adjacent the nozzle on the surface of the track means, the fluid stream pushing the selected items off the track means to the other side thereof.

6. The apparatus of claim 5 wherein the means for further separating comprises a pair of rollers, the selected items of flatware being delivered by gravity to between the rollers.

7. The apparatus of claim 6 wherein the rollers are separated a distance apart sufficient to allow certain of the selected items delivered to between the rollers to pass through the separation and to prevent certain other of the selected items delivered to between the rollers from passing through the separation.

8. The apparatus of claim 7 wherein the track means is mounted at an angle relative to horizontal sufficient to allow the items of flatware to slide along the top surface of the track means under the force of gravity.

9. The apparatus of claim 8 wherein the rollers are mounted at an angle relative to horizontal sufficient to allow the certain other items of the flatware which are prevented from passing through the separation to slide along the length of the rollers under the force of gravity.

10. The apparatus of claim 9 wherein the rollers are drivably rotated, the angle of mounting of the rollers being selected to allow the certain other items of the flatware prevented from passing through the separation to slide along the length of the rollers under the force of gravity while the rollers are rotating.

11. The apparatus of claim 10 further comprising a baffle means for directing the selected items of the flatware pushed off the track means by the stream to between the rollers, the baffle means being mounted on the other side of the track means in the path of the stream of fluid, the stream of fluid pushing the selected items of flatware into contact with the baffle means, the baffle means including means for directing the selected items of flatware to between the rollers under the force of gravity.

12. The apparatus of claim 11 further comprising means for delivering no more than two individual items of flatware at a time onto the top surface of the track means.

13. The apparatus of claim 4 further comprising means for delivering no more than two individual items of flatware at a time onto the top surface of the track means.

14. The apparatus of claim 4 wherein the track means is mounted at an angle relative to horizontal sufficient to allow the items of flatware to slide along the top surface of the track means under the force of gravity.

15. The apparatus of claim 6 further comprising a baffle means for directing the selected items of the flatware pushed off the track means by the stream to between the rollers, the baffle means being mounted on the other side of the track means in the path of the stream of fluid, the stream of fluid pushing the selected items of flatware into contact with the baffle means, the baffle means including means for directing the selected items of flatware to between the rollers under the force of gravity.

16. The apparatus of claim 7 wherein the rollers are mounted at an angle relative to horizontal sufficient to allow the certain other items of the flatware which are prevented from passing through the separation to slide along the length of the rollers under the force of gravity.

17. The apparatus of claim 16 wherein the rollers are drivably rotated, the angle of mounting of the rollers being selected to allow the certain other items of the flatware prevented from passing through the separation to slide along the length of the rollers under the force of gravity while the rollers are rotating.

18. The apparatus of claim 16 wherein the rollers are mounted side by side with one of the rollers being mounted at a slightly greater angle than the other, the one roller rotating in a direction upwardly and outwardly from the separation between the rollers.

19. The apparatus of claim 18 wherein the other roller rotates in the same direction as the one roller.

20. The apparatus of claim 19 wherein the one roller rotates faster than the other roller.

21. The apparatus of claim 18 wherein the one roller includes a selected array of protrusions on the surface thereof.

22. The apparatus of claim 8 further comprising means for delivering no more than two individual items of flatware at a time onto the top surface of the track means.

23. The apparatus of claim 9 further comprising a baffle means for directing the selected items of the flatware pushed off the track means by the stream to between the rollers, the baffle means being mounted on the other side of the track means in the path of the stream of fluid, the stream of fluid pushing the selected items of flatware into contact with the baffle means, the baffle means including means for directing the selected items of flatware to between the rollers under the force of gravity.

24. The apparatus of claim 9 further comprising means for delivering no more than two individual items of flatware at a time onto the top surface of the track means.

25. The apparatus of claim 7, 8, 9, 10 or 11 wherein the certain selected items allowed to pass through the separation of the rollers are forks and the other certain selected items of flatware prevented from passing through the separation of the rollers are spoons.

26. The apparatus of claim 1, 4, 5 or 6 wherein the flatware is a combination of knives, forks and spoons or knives and forks, or knives and spoons or forks and spoons and wherein the selected items of flatware carried off the surface of the track means by the fluid stream are forks, spoons and combinations thereof.

27. The apparatus of claim 1 wherein the means for further separating comprises a pair of rollers, the selected items of flatware being delivered by gravity to between the roller 28. The apparatus of claim 27 wherein the rollers are separated a distance apart sufficient to allow certain of the selected items delivered to between the rollers to pass through the separation and to prevent certain other of the selected items delivered to between the rollers from passing through the separation.

29. The apparatus of claim 28 wherein the rollers are mounted at an angle relative to horizontal sufficient to allow the certain other items of the flatware which are prevented from passing through the separation to slide along the length of the rollers under the force of gravity.

30. The apparatus of claim 29 wherein the rollers are mounted side by side with one of the rollers being mounted at a slightly greater angle than the other, the one roller rotating in a direction upwardly and outwardly from the separation between the rollers.

31. The apparatus of claim 30 wherein the other roller rotates in the same direction as the one roller.

32. The apparatus of claim 31 wherein the one roller rotates faster than the other roller.

33. The apparatus of claim 30 wherein the one roller includes a selected array of protrusions on the surface thereof.

34. The apparatus of claim 1 wherein the means for contacting comprises a driven roller wheel disposed across the path of the track means so as to contact the selected items of flatware and far enough above the top surface of the track means so as not to contact the other selected items of flatware.

35. Apparatus for separating a collection of knives, forks and spoons comprising:

a track means having a top inclined surface for receiving and allowing individual items of knives, forks and spoons to slide therealong;

a fluid spray means for directing a stream of fluid across the top surface of the track means at a selected point along the length of the track means;

the fluid stream being directed across the top surface of the track means at a height above the top surface of the track means selected to cause the fluid stream to contact at least a portion of the forks and spoons sliding past the fluid stream on the track means and to prevent the fluid stream from contacting knives sliding past the stream on the track means;

the fluid stream pushing forks and spoons with which the stream comes into contact off the track means; and means for separating the forks and spoons pushed off the track means, the forks and spoons pushed off the track means being delivered by gravity to the means for separating.

36. The apparatus of claim 35 wherein the means for separating the forks and spoons comprises a pair of rollers separated a selected distance apart, the forks and spoons pushed off the track means being delivered by gravity to between the rollers, the separation distance between the rollers being selected to allow the forks to slide therethrough and to prevent the spoons from sliding therethrough.

37. The apparatus of claim 36 wherein the rollers are mounted at an angle relative to horizontal sufficient to allow the spoons delivered to between the rollers to slide along the length of the rollers under force of gravity.

38. The apparatus of claim 37 wherein the rollers are drivably rotated imparting mechanical agitation to the forks and spoons delivered to between the rollers.

39. The apparatus of claim 36 wherein the rollers are drivably rotated imparting mechanical agitation to the forks and spoons delivered to between the rollers.

* * * * *